United States Patent [19]

Phillips

[11] Patent Number: 4,572,464

[45] Date of Patent: Feb. 25, 1986

[54] CHANGE-CONFIGURATION CLIMBING CHOCK

[76] Inventor: Douglas D. Phillips, Star Rte. 2193, Camp Sherman, Oreg. 97730

[21] Appl. No.: 542,687

[22] Filed: Oct. 17, 1983

[51] Int. Cl.[4] ..... A63B 29/02

[52] U.S. Cl. ..... 248/1

[58] Field of Search ..... 248/1, 215, 200; 24/136 R, 115 N

[56] References Cited

U.S. PATENT DOCUMENTS 3,903,785 9/1975 Peppers ..... 248/1
4,082,241 4/1978 Burkey ..... 248/1

FOREIGN PATENT DOCUMENTS 0047232 3/1982 European Pat. Off. .
047232 10/1982 European Pat. Off. ..... 248/1
2911952 10/1980 Fed. Rep. of Germany .
2440206 7/1980 France ..... 248/1

*Primary Examiner*—Reinaldo P. Machado
*Assistant Examiner*—Alvin Chin-Shue
*Attorney, Agent, or Firm*—Kolisch, Hartwell & Dickinson

[57] ABSTRACT

An artificial chock stone for use by rock climbers to provide a protection point. The chock comprises a pair of slidably engaged wedges which are adjustable between a large dimension and a small dimension upon relative sliding of the wedges, which are biased to a large dimension. The device may be inserted and provide a secure protection point in a narrow, smooth-walled, paralleled-sided crevice and is constructed to provide a point of attachment to which a safety line may be secured.

5 Claims, 8 Drawing Figures

CHANGE-CONFIGURATION CLIMBING CHOCK

BACKGROUND AND SUMMARY OF THE INVENTION

The invention of the present application pertains to rock climbing aides. Specifically, the instant invention pertains to an artificial chock stone which a climber may use to provide a point of protection which is intended to be anchored in a narrow, smooth-wall, parallel-side crevice.

An artificial chock stone in the known prior art is simple metallic device with a cable molded into it, which is placed in a V-type crevice and which is used in conjunction with a nylon strap to provide a point of protection.

Another type of artificial chock stone utilizes camming action which causes a rotatable head portion, mounted on a rigid body, to produce an enlarged cross section when it is inserted and lodged in a crevice. An artificial chock stone of this type is best suited for large cracks and/or those with rough walls.

Known prior artificial chock stones are not suitable for use in cracks of ¾-inch or less cross section and which have parallel sides and smooth walls.

An object of the instant invention, then, is to provide and artificial chock stone which will provide a protection point by lodging in a narrow crack.

Another object of the instant invention is to provide an artificial chock stone which will provide a point of protection in a smooth-wall, parallel-side crevice.

A further object of the instant invention is to provide an artificial chock stone which may be manipulated for easy insertion and removal in a one-handed plunger-type operation.

Still another object of the instant invention is to provide an artificial chock stone which is lightweight and of simple construction.

Yet another object of the instant invention is to provide an artificial chock stone which has a flexible body portion.

The climbing chock of the instant invention includes a pair of interlocked, variable cross section wedges which are spring biased to an expanded position. The wedges are connected to a loop which receives a carabiner ring or rope to secure the climber to a rock face. The chock stone of the instant invention is configured such that should a climber fall, the additional weight of the climber on the safety line attached to the climbing chock cooperates with the biasing mechanism of the climbing chock to further urge the variable cross-sectioned wedges to a larger configuration, thereby providing an additional safety margin. The instant invention features a flexible body portion which is generally capable of conforming to a curved interior or edge of a crevice. The wedges of the instant climbing chock include a malleable gripping surface on one of the wedge's outer margins and a low-friction, wear-resistant surface on the other wedge's outer margin, to promote insertion, removal and gripping ability.

These and other objects and advantages of the instant invention will become more fully apparent as the description which now follows in read in conjunction with the drawings.

DETAILED DESCRIPTION OF THE PREFERRED EMBODIMENT

Figure 1:
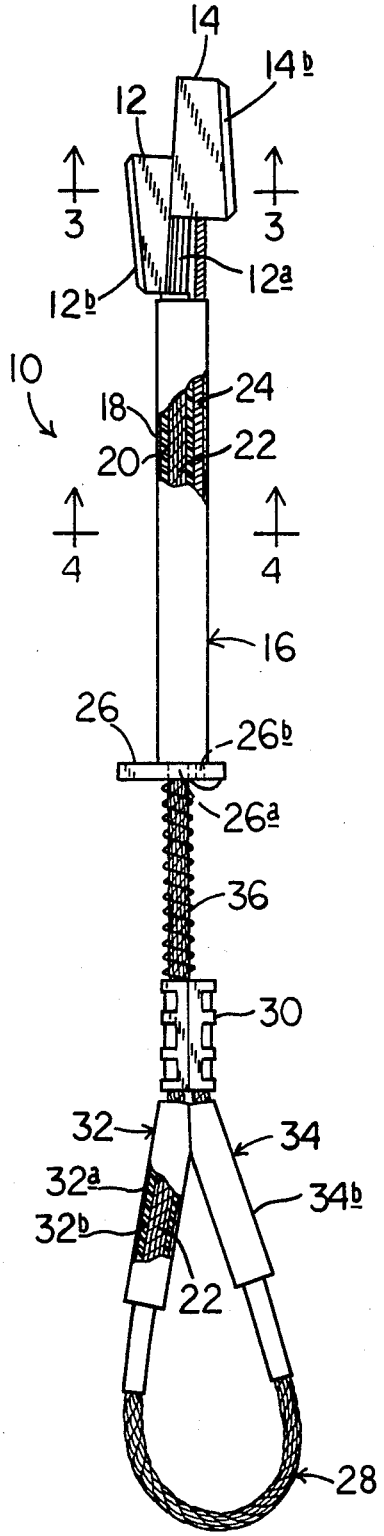
FIG. 1 is a plan view of a change-configuration climbing chock according to the instant invention, showing a pair of wedge elements biased to a large dimension.
Figure 2:
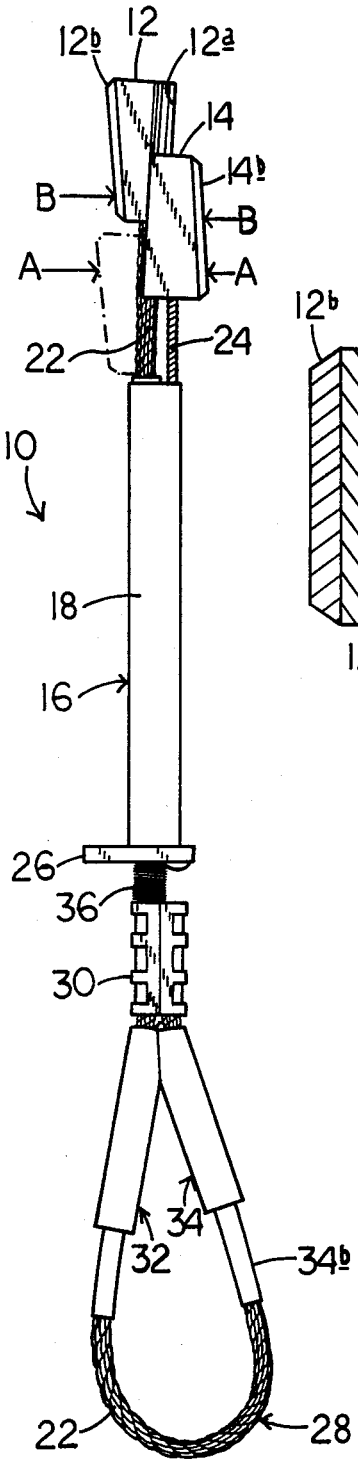
FIG. 2 is a plan view of a change-configuration climbing chock, showing a pair of wedge elements in a small dimension.

Turning now to the drawings and specifically to FIGS. 1 and 2, a change-configuration climbing chock constructed according to the instant invention is shown generally at 10.

Figure 3:
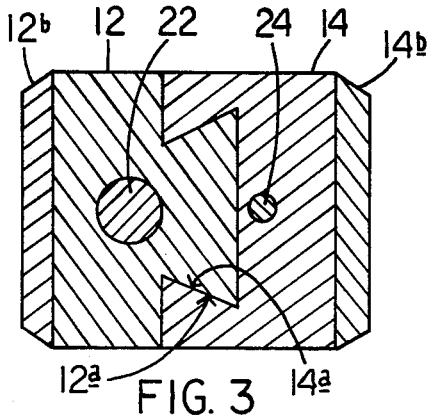
FIG. 3 is an enlarged cross section of a pair of wedge elements, taken generally along the lines 3—3 in FIG. 1.

Chock 10 includes a first wedge, or wedge means, 12 and a second wedge, or wedge means, 14. Wedges 12 and 14 are slidably, rectilinearly engaged to one another by means of a v-grooved tenon **12*a*, which is conformal with a v-groove mortise 14*a* (shown in FIG. 3). Tenon 12*a* and mortise 14*a* slidably interlock wedges 12 and 14**.

Wedge 12 includes a low-friction, wear-resistant surface **12*b*; wedge 14 further includes a malleable gripping surface 14*b***.

Figure 4:
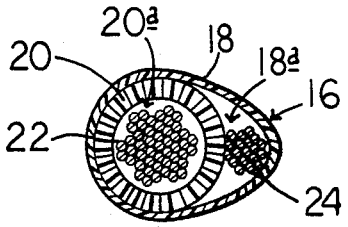
FIG. 4 is an enlarged cross section of a flexible body portion of a change-configuration climbing chock, taken generally along the line 4—4 in FIG. 1.

A flexible, tubular body portion 16 is located adjacent to wedges 12 and 14. Flexible body portion 16 includes an outer sheath 18 and an inner sheath 20, as depicted in the cut-away portion of FIG. 1, and in FIG. 4. Outer sheath 18, in the preferred embodiment, is formed of a heat-shrink neoprene rubber material. Inner sheath 20 is formed of teflon tubing. The area between outer sheath 18 and inner sheath 20 forms what is referred to herein as one hollow chamber **18*a*, and the interior cavity of sheath 20 forms what is referred to herein as another hollow chamber, 20*a***.

A first flexible cable 22 is secured to wedge 12, and extends through hollow chamber **20*a*, in inner sheath 20. A second flexible cable 24 is attached to wedge 14 and extends through hollow chamber 18*a*. Both flexible cables, in the preferred embodiment, are formed of 302/304 stainless steel aircraft cable. Cable 22 is ⅛-inch 7×7 wire rope; cable 24** is 1/16-inch 1×19 wire rope.

A disc-shaped flange, or grip means, 26 is located at an end of body portion 16 opposite wedges 12 and 14. Flange 26 includes a pair of bores: bore **26*a* passes through the center of flange 26, and first flexible cable 22 passes through and is freely slidable therein. A second bore, 26*b*, is located intermediate the edge and center of flange 26, and second flexible cable 24** passes therethrough and is securely attached to a side of the flange, as by welding.

The first flexible cable extends through flange 26, which is also referred to herein as adjustment means, and is formed into a reverse bend loop, shown generally at 28, the free end of cable 22 being fastened at a point intermediate flange 26 and the bend of loop 28 by a collar 30. Loop 28 and collar 30 form what is referred to as attachment means.

Loop 28 is partially enclosed by a pair of cable covers, 32, 34. Each cable cover includes an outer portion 32*a*, 34*b*, and an inner portion, representatively shown at 32*b*, which extends from an area adjacent collars 30 to the point short of an end of outer portion 32*a*. Covers 32, 34 provide a non-abrasive surface which a climber may grasp. The outer portion of the cable covers in the embodiment depicted are formed from heat-shrink neoprene rubber. Alternately, the entire loop may be coated as by dipping the loop in a coating solution. The inner portion of the cable cover is formed of plastic tubing.

Interposed collar 30 and flange 26, is yieldable biasing means, which takes the form of a coil spring 36 in the preferred embodiment. Spring 36 abuts flange 26 and collar 30, and surrounds a portion of cable 22. Spring 36 tends to urge collar 30 away from flange 26.

Referring now to FIG. 1 and 2, the wedges are shown to be rectilinearly slidable relative one another. As the wedges are moved relative one another, the overall lateral dimension of the combined wedge cross section changes. The wedges are adjustable from a large dimension, as shown in FIG. 1 and indicated by arrows A—A in FIG. 2 of less than 1-inch cross section, to a small dimension, as shown in FIG. 2, and indicated by arrows B—B in FIG. 2. This change-configuration feature of the climbing chock of the instant invention is accomplished by retaining second wedge 14 at a fixed distance from body portion 16 and allowing first wedge 12 to move relative body portion 16 and second wedge 14. Spring 36 coacts with first flexible cable 22 and first wedge 12 to urge the wedge means to its large dimension by relative sliding of the wedges.

As shown in FIG. 2, the configuration of the wedge means may be changed by sliding cable 22 through bore 26*a* and inner sheath 20, thereby compressing spring 36, with what is described herein as plunger action. The wedges are configured in their large dimension when coil spring 36 is allowed to expand, thereby forcing collar 30 away from flange 26 and thereby drawing cable 22 through bore 26*a* thus moving wedge 12 relative to wedge 14.

It can be seen that the chock stone of the present application is of simple construction. The chock stone weighs only a few ounces.

Figure 5:
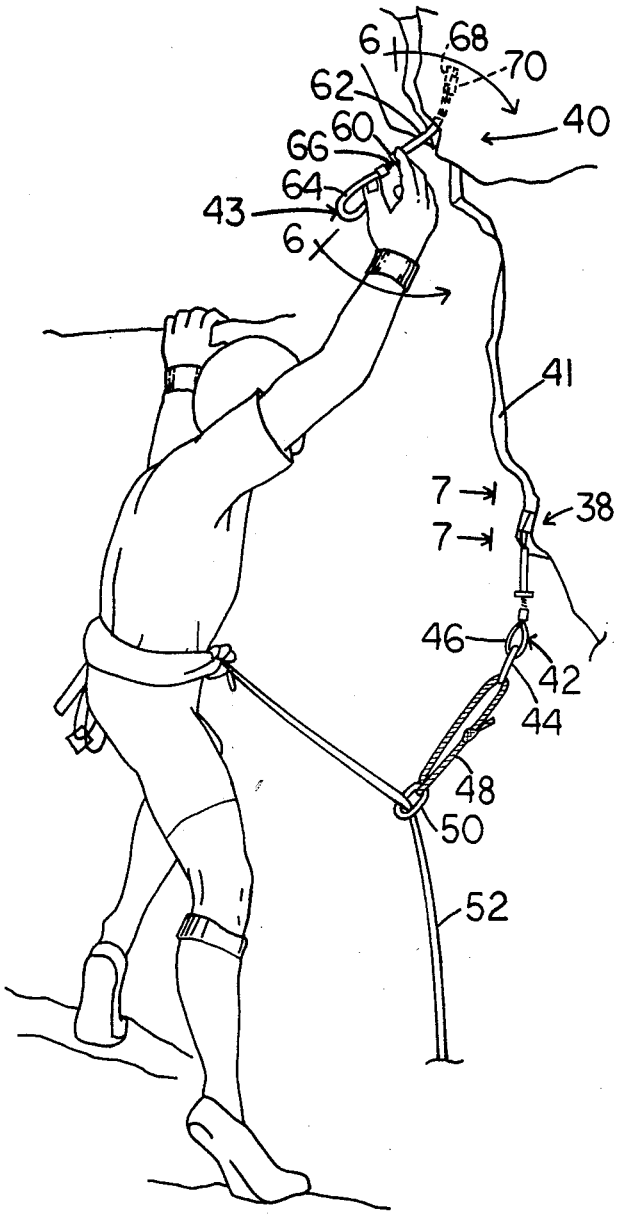
FIG. 5 is a drawing of a rock climber protected at one point and establishing a protection point at a second location, using a change-configuration climbing chock according to the instant invention.

Turning now to FIG. 5, a rock climber is depicted. The rock climber has established a first protection point, shown generally at 38 utilizing a change-configuration climbing chock 42 of the present invention, and is in the process of establishing a second protection point, by inserting a change-configuration climbing chock 43 in a crevice or crack, shown generally at 41.

Turning to the first protection point, 38, in FIG. 5, a climbing chock according to the instant invention is shown at 42. A carabiner ring 44 is attached through reverse bend loop 46 of climbing chock 42. A webbing strap 48 is affixed through ring 44, and a second carabiner ring 50 is attached at an end of strap 48 opposite first carabiner ring 44. A safety line 52 passes through carabiner ring 50 and is secured to the climber. Line 52 is belayed at some point down the side of the climbing surface, generally by another climber.

Were the climber depicted in FIG. 5 to fall from his position, climbing chock 42 would provide a protection point for the climber and provide a fixed anchor which is capable of restraining the climber from a free fall. Should the climber fall, the force produced by line 52 in stopping the climber's downward motion, would be transmitted, ultimately, to loop 46. A force thus transmitted to loop 46 would further tend to urge the wedge means to their large dimension configuration, further securing chock 42 in crack 41. The chock of the invention has been tested to withstand a vertical force of 1,600 pounds.

Figure 7:
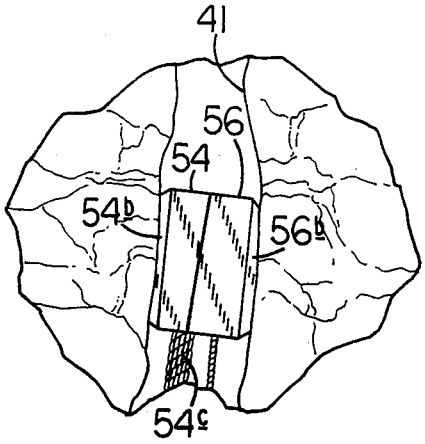
FIG. 7 is an enlarged portion of FIG. 5, taken generally along the lines 7—7 of FIG. 5.

Turning momentarily to FIG. 7, the wedges of chock 42 are depicted in place in crevice 41. Specifically, crevice 41 is what is known as a smooth-walled, parallel-side crevice. Crevice 41 is depicted as having a dimension of an inch or less in width. One of the advantages of the climbing chock of the instant invention is that it will provide a positive protection point in a relatively smooth wall, parallel-sided crevice. As previously stated, the first wedge has a low-friction, wear-resistant outer surface, such as stainless steel. The second wedge has an outer gripping surface, such as a lead-tin solder. As shown in FIG. 7, a first wedge 54 has low friction, wear-resistant surface 54*b* and a second wedge 56 has a gripping surface 56*b*. In order to provide a more secure protection point, surface 54*b* allows wedge 54 to slide relative wedge 56 when both wedges are in position in a crevice. The gripping surface 56*b* does not permit wedge 56 to move. Should a sudden increase of force be applied to a first flexible cable 54*c*, which is attached to wedge 54, wedge 54 will slide relative wedge 56, thereby producing an additional increase in the wedges' lateral dimension, further securing the chock within the crevice.

Figure 6:
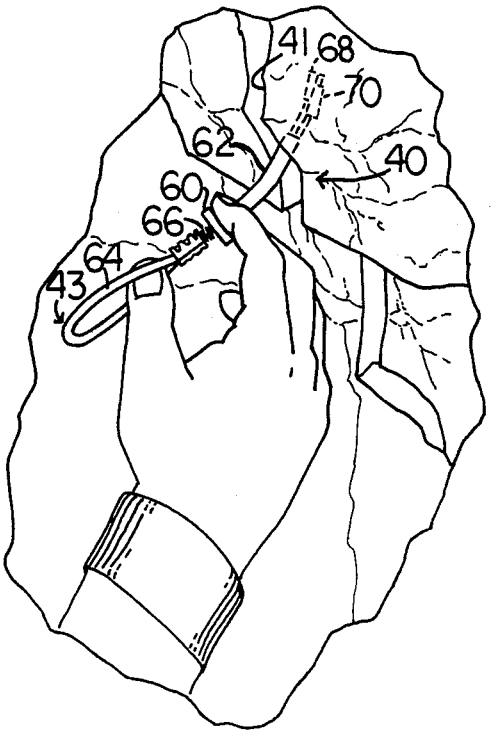
FIG. 6 is an enlarged portion of FIG. 5, showing insertion of a change-configuration climbing chock, taken generally along the lines 6—6 of FIG. 5.

Referring to FIGS. 5 and 6, a change-configuration climbing chock constructed according to the instant invention is being inserted, generally at 40, into crevice 41. The climber has gripped a climbing chock 43 about the area of a flange 60 and is holding a body portion 62 between his index and middle fingers. The climber's thumb is inserted through a loop 64 and a spring 66 has been compressed, causing the wedges 68, 70, to shift to their small dimension. This action depicts the middle step in what is described as one-handed, three-step fixing of the chock: the first step is the act of gripping the chock as described and compressing the spring. The second step is that of inserting the chock with the wedge means in their small dimension into a crevice. The third step is that of releasing the chock thereby allowing the springs to shift the wedge means towards their large dimension. The chock is thus placed with one hand, allowing the climber to maintain a safety grip with his other hand while establishing a protection point.

Once the chock is in place, a webbing strap will be attached to the loop by means of a carabiner ring. The safety line will be run through another carabiner ring, attached to the webbing strap. The chock will provide a secure anchor, which may be used as a protection point, a belay anchor, or a rappel anchor.

Referring to FIG. 6, chock 43 and crevice 41 are shown in greater detail. At this point, crevice 41 still is a narrow, smooth-walled, parallel-sided crevice. However, the interior crevice walls define an S-curve. A climbing chock according to the invention 43 is shown as it is inserted into crevice 41. The spring has been compressed and the wedges are in their small dimension. A body portion 62 of the chock substantially conforms to the curved interior of crevice 41. An important feature of the chock of the instant invention is the ability of the chock body to conform to curved or irregular shaped, narrow crevices. This feature is not found in known prior art.

While the body portion is flexible, it is not so flexible that it will not provide sufficient stability to assist in removal of the chock once the chock is no longer required as a protection point. Removal is accomplished through digital manipulation of the chock and is a one-handed, three-step procedure: the flange is gripped between the index and middle finger with the thumb inserted through the loop and spring then compressed. It has been found that it is generally possibly to remove the chock by compressing the spring and exerting a slight forward (towards the wedges) force which assists in adjusting the wedges to their small dimension. Once the wedges have been adjusted to their small dimensions, the chock may be withdrawn from the crevice. A third step is merely that of releasing the compressive force on the springs and allowing the chock to return to its normally biased, large dimension.

Figure 8:
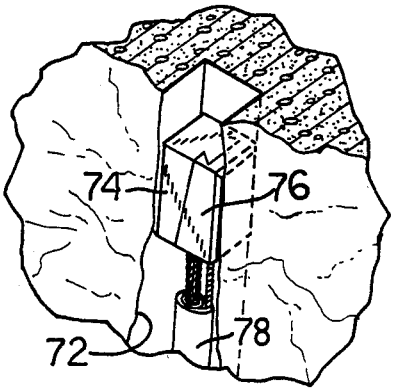
FIG. 8 depicts a changed-configuration climbing chock inserted in a bottoming crevice.

Another important advantage of the climbing chock of the present invention is its ability to provide a protection point in a shallow crevice. FIG. 8 depicts a bottoming crevice 72. Wedges 74, 76, and a portion of a chock body 78 are shown as illustrative of how the instant chock would be used in a bottoming crevice. The wedges of the instant chock are typically an inch long and ½-inch square. As such, they will provide an adequate protection point in any crevice which allows full insertion of both wedges, either in a crevice which is itself ½-inch deep, as shown, or in an overhead crevice which is at least one-inch deep. Again, this is a feature which known prior art climbing chocks do not possess: minimal insertion depth required for a cam-type artificial chock stone is generally two or three inches.

Thus, a new change-configuration climbing chock has been disclosed which allows a rock climber to secure an artificial protection point in a narrow, smooth-walled, parallel-sided crevice. The climber may insert and fix the chock with one hand, while stabilizing himself with his other hand. The advantages of this device over prior art is that the present invention contains a flexible body portion which may conform to irregularities in crevice formation.

While a preferred embodiment of the invention has been described, it is appreciated that variations and modifications may be made without departing from the spirit of the invention.

It is claimed and desired to secure by Letters Patent:

1. A change-configuration climbing chock for providing a protection point for a rock climber comprising an elongate, flexible tubular body with plural hollow chambers, and with a flange at one end, a first flexible cable with one end formed in a reverse bend loop and fastened with a collar, with a free end extending interiorly through one of said body's hollow chambers, and exposed at said body's other end, a second flexible cable fixedly attached adjacent said flange and extending interiorly through another of said body's hollow chambers, first and second wedge elements rectilinearly engaged, slidable between a large lateral dimension and a small lateral dimension, each secured to one of said cables, means for preventing non-linear displacement of said wedge elements, and yieldable biasing means acting between said collar and said flange, tending to urge the wedges to their large lateral dimension.

2. The climbing chock of claim 1, which includes grip means for providing one-handed, three-step fixing of said chock in a crevice.

3. The climbing chock of claim 2, which is constructed such that an addition of weight on said reverse bend loop complements said yieldable biasing means in positioning the wedge means to their large lateral dimension.

4. The climbing chock of claim 1 wherein said means for preventing non-linear displacement includes a v-grooved tenon on one of said wedge elements and a conformal v-grooved mortise on the other of said wedge elements.

5. A change-configuration climbing chock for providing a protection point for a rock climber comprising:

first and second wedge elements rectilinearly engaged, slidable between a large lateral dimension and a small lateral dimension, one of said elements having a v-grooved tenon thereon, and the other of said elements having a v-grooved mortise thereon, said tenon and mortise being conformal to prevent non-linear displacement of said elements;

an elongate, flexible tubular body with plural hollow chambers, and with a flange at one end;

a first flexible cable with one end formed in a reverse bend loop and fastened with a collar, with a portion extending interiorly through one of said body's hollow chambers, and an exposed end extending beyond said body's other end, the exposed end being secured to one of said wedge elements;

a second flexible cable fixedly attached adjacent said flange and extending interiorly through another of said body's hollow chambers, having a free end secured to the other of said wedge elements; said tubular body extending a majority of the length of said cables; and yieldable biasing means acting between said collar and said flange, tending to urge the wedge elements to their large lateral dimension.

* * * * *